US008662849B2

(12) United States Patent
Giglio et al.

(10) Patent No.: US 8,662,849 B2
(45) Date of Patent: Mar. 4, 2014

(54) COMPONENT OF A TURBINE BUCKET PLATFORM

(75) Inventors: Anthony Louis Giglio, Simpsonville, SC (US); Sergio Daniel Marques Amaral, Simpsonville, SC (US); Mark Steven Honkomp, Taylors, SC (US); Camilo Andres Sampayo, Greer, SC (US)

(73) Assignee: General Electric Company, Schenectady, NY (US)

( * ) Notice: Subject to any disclaimer, the term of this patent is extended or adjusted under 35 U.S.C. 154(b) by 526 days.

(21) Appl. No.: 13/026,873

(22) Filed: Feb. 14, 2011

(65) Prior Publication Data

US 2012/0207613 A1 Aug. 16, 2012

(51) Int. Cl.
*F01D 5/30* (2006.01)

(52) U.S. Cl.
USPC ..... 416/193 A; 416/241 R

(58) Field of Classification Search
USPC ..... 416/193 A, 241 R, 248
See application file for complete search history.

(56) References Cited

U.S. PATENT DOCUMENTS

| | | | | |
|---|---|---|---|---|
| 4,872,812 | A * | 10/1989 | Hendley et al. | 416/190 |
| 6,670,046 | B1 | 12/2003 | Xia | |
| 6,811,373 | B2 * | 11/2004 | Tomita et al. | 415/173.1 |
| 7,244,101 | B2 * | 7/2007 | Lee et al. | 416/97 R |
| 7,309,212 | B2 | 12/2007 | Itzel et al. | |
| 7,645,123 | B1 | 1/2010 | Liang | |
| 8,016,549 | B2 * | 9/2011 | Shah et al. | 415/134 |
| 2002/0141869 | A1 * | 10/2002 | Lee et al. | 416/97 R |
| 2006/0110254 | A1 * | 5/2006 | Itzel et al. | 416/193 A |
| 2007/0116574 | A1 | 5/2007 | Itzel et al. | |
| 2009/0017260 | A1 | 1/2009 | Kulkarni et al. | |
| 2010/0192588 | A1 | 8/2010 | Gerendas | |

* cited by examiner

*Primary Examiner* — Nathaniel Wiehe
*Assistant Examiner* — Woody A Lee, Jr.
(74) *Attorney, Agent, or Firm* — Cantor Colburn LLP

(57) ABSTRACT

A component is provided and includes a first surface, a second surface adjacent to and oriented transversely with respect to the first surface and having a pocket formed therein defining a rib along a periphery thereof and a thermal barrier coating (TBC) respectively applied to the first surface and to the second surface at the pocket such that the rib is interposed between the TBC of the first and second surfaces.

20 Claims, 3 Drawing Sheets

COMPONENT OF A TURBINE BUCKET PLATFORM

BACKGROUND OF THE INVENTION

The subject matter disclosed herein relates to a component of a turbine bucket platform and, more particularly, to a component of a turbine bucket platform on which a thermal barrier coating (TBC) is applied.

Gas turbines have been used widely in various fields as power sources and include compressors, combustors and turbines. In a gas turbine, air is compressed by the compressor and then combusted along with fuel by the combustor to produce high energy fluids expanded by the turbine to obtain power. As such, a temperature increase for the high energy fluids enhances power generation. Thus, in an effort to derive increased power generation, gas turbines have been recently designed to generate such high energy fluids with increased temperatures.

In order to provide turbine components that can survive and withstand the increased temperatures of the high energy fluids, those components have been made with heat resisting alloys and coated with thermal barrier coating (TBC). While the TBC is intact, the TBC operates by restraining heat conduction into the coated component to thereby prevent damage and extend the component's lifetime. It is often the case, however, that TBC does not remain in this condition and, indeed, TBC may deteriorate and/or peels off from the component at various positions.

BRIEF DESCRIPTION OF THE INVENTION

According to one aspect of the invention, a component is provided and includes a first surface, a second surface adjacent to and oriented transversely with respect to the first surface and having a pocket formed therein defining a rib along a periphery thereof and a thermal barrier coating (TBC) respectively applied to the first surface and to the second surface at the pocket such that the rib is interposed between the TBC of the first and second surfaces.

According to another aspect of the invention, a turbine bucket platform is provided and includes a first surface of a turbine bucket platform facing a gas path, a second surface of at least one of a slashface adjacent to the turbine bucket platform surface and a surface of the turbine bucket platform facing an aft trench cavity, the second surface having a pocket formed therein defining a rib along a periphery thereof and a thermal barrier coating (TBC) respectively applied to the first surface and to the second surface at the pocket such that the rib is interposed between the TBC of the first and second surfaces.

According to yet another aspect of the invention, a method is provided and includes applying a thermal barrier coating (TBC) to a first surface, forming a pocket in a second surface adjacent to and oriented transversely with respect to the first surface to define a rib along a periphery of the pocket and applying TBC to the second surface at the pocket such that the rib is interposed between the TBC of the first and second surfaces.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

Figure 1:
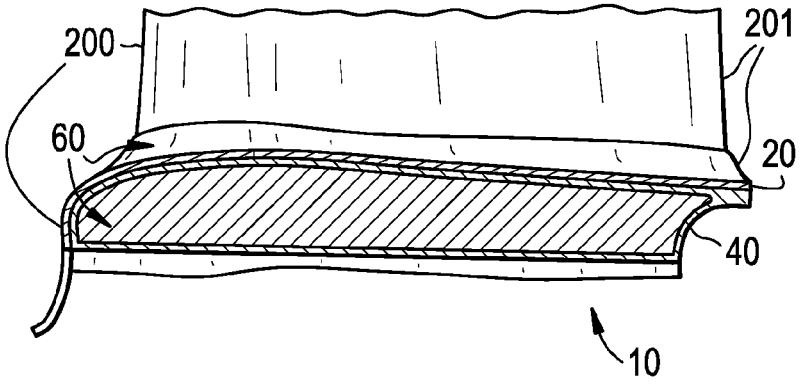
FIG. 1 is a side view of a component.
Figure 2:
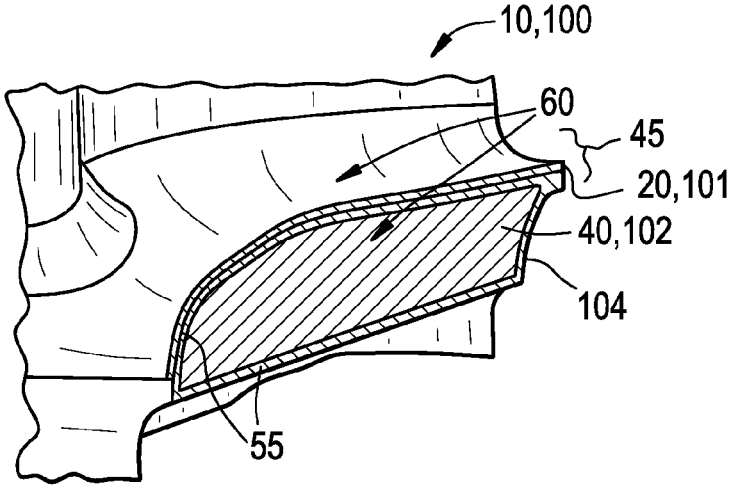
FIG. 2 is a perspective view of the component of FIG. 1.

The detailed description explains embodiments of the invention, together with advantages and features, by way of example with reference to the drawings.

DETAILED DESCRIPTION OF THE INVENTION

As a consequence of improvements in gas turbine efficiency and emissions levels, combustion exhaust flows produce more substantially uniform temperature profiles in the radial direction. This translates into significant increases in gas temperatures near turbine endwalls where hot gas path surfaces meet adjacent component surfaces. Prevention of heat fluxes due to hot gas ingestion along these surfaces by way of a thermal barrier coating (TBC) application to the surfaces prevents heat fluxes into the component, which subsequently prevents increases in metal temperatures and leads to lengthened component life. The use of TBC also lessens a need for active cooling.

With reference to FIGS. 1-5, a turbine bucket platform component 10 (hereinafter referred to as a "component 10") of, for example, a turbine is provided and includes a first surface 20, a second surface 40 and TBC 60. The second surface 40 is adjacent to and oriented transversely with respect to the first surface 20 such that an interface zone 45, which is formed where the first and second surfaces 20, 40 meet, is angular. More particularly, the interface zone 45 may be right angular or, in some cases, sharply or acutely angular. The second surface 40 has a pocket 50 formed therein to define a rib 55 along a periphery thereof The TBC 60 is respectively applied to the first surface 20 and to the second surface 40 at the pocket 50 such that less than 100% of the second surface 40 is covered and the rib 55 is interposed between the TBC 60 of each of the first and second surfaces 20, 40 and such that the separate portions of the TBC 60 of each of the first and second surfaces 20, 40 are substantially isolated from one another. The separation between the separate portions of the TBC 60 of each of the first and second surfaces 20, 40 provides heat flux directional control not otherwise available.

The component 10 may be any component of a turbine or a gas or steam turbine in which high energy fluids are expanded for power generation purposes. Thus, the first and second surfaces 20, 40 may each include surfaces facing a gas path along which fluids having relatively high temperatures flow. In general, such relatively high fluid temperatures occur where the fluid temperatures exceed the temperatures of the interior of the component 10 such that the TBC 60 prevents heat flux from the fluid into the component 10 and such that interior temperatures of the component 10 can be maintained below predefined levels. As an example, the component 10 may be a turbine bucket platform 100 of a gas turbine engine. In this case, the first surface 20 includes a surface 101 of the turbine bucket platform 100 that faces a hot gas path. Further, the second surface 40 may include at least one of a surface of a slashface 102, which is disposed adjacent to the surface 101 of the turbine bucket platform 100, and an aft trench cavity facing surface 104 of the turbine bucket platform 100.

Figure 3:
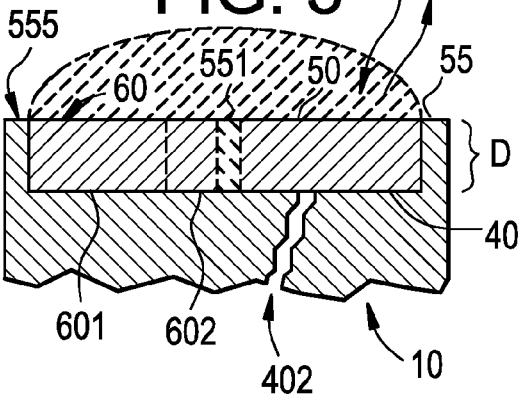
FIG. 3 is a schematic view of a pocket of the component of FIGS. 1 and 2 according to embodiments.
Figure 4:
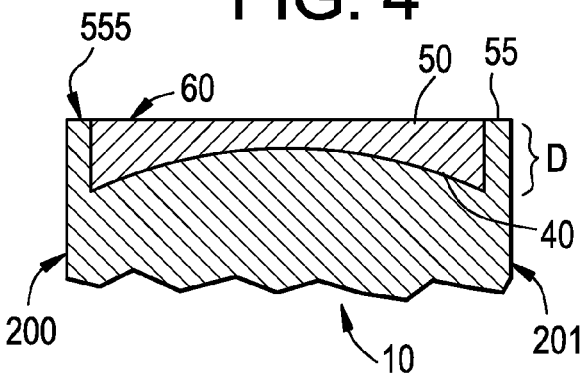
FIG. 4 is a schematic view of a pocket of the component of FIGS. 1 and 2 according to alternate embodiments.

With reference to FIGS. 3 and 4, a depth of the pocket 50 may be uniform, varied, incrementally variable or continuously variable as measured from a plane of a distal edge 555 of the rib 55. That is, as shown in FIG. 3, the pocket 50 depth, D, may be substantially uniform. In contrast, as shown in FIG. 4, the pocket 50 depth, D, may be greatest or deepest proximate to at least one of a leading and a trailing edge 200, 201 of the first surface 20 where fluid temperatures may be expected to be highest and where heat flux into the component 10 may be expected to be greatest. Similarly, the pocket 50 depth, D, may be shallowest near a center of the pocket 50 where fluid temperatures may be expected to be lowest and where heat flux into the component 10 may be expected to be lowest.

In accordance with embodiments, as shown in FIG. 3, the TBC 60 of the second surface 40 may be formed as a single continuous coating or as non-continuous sections 601 and 602. The non-continuous sections 601, 602 may all have similar thicknesses or they may have differing thicknesses to control air flow, gap size (see mate face gap, G, of FIG. 5) or heat flux into the underlying portions of the second surface 40. Also, the second surface 40 may be formed to define an active cooling section, such as a microchannel 402. This microchannel 402 leads toward a backside of the TBC 60 of the second surface 40 and thereby provides cooling flow to the TBC 60 that may enhance an insulating effect.

An exposed edge of the rib 55 or another similar component may be available as a sacrificial environment condition indicator whereby the edge can be used as a tuned real-time health monitoring differential with calibration being related to edge and mate face gap, G, dimensions.

Figure 5:
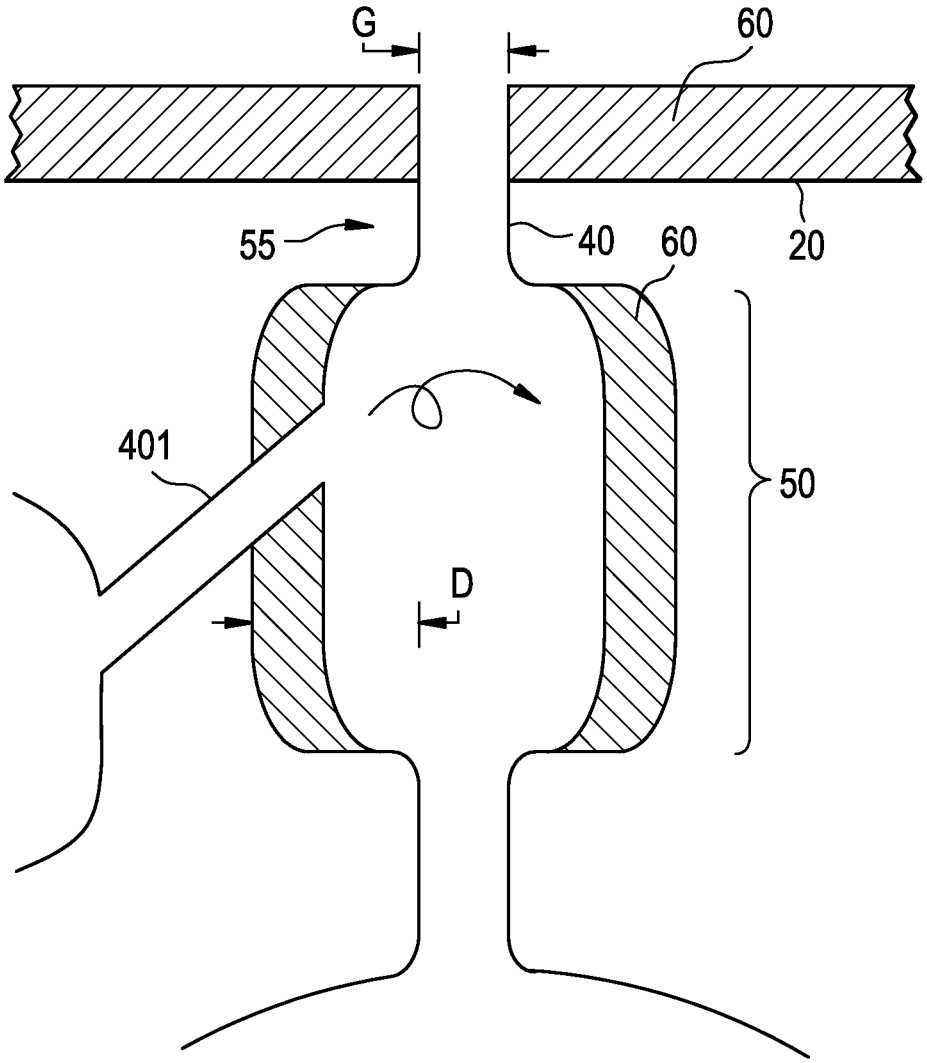
FIG. 5 is an enlarged schematic view of a slashface edge hardware interface.

In addition, as shown in FIG. 5, the depth, D, of the pocket 50 may exceed the depth or height of the TBC 60. That is, the pocket 50 may be flush with the plane of the distal edge 555 of the rib 55 or depressed to form a land edge. This land edge may possess curvature to entrain, control or trap cooling flow provided via, for example, film hole 401 within mate face gap, G. Even without such cooling flow, the pocket 50 may still provide for enhanced flow path edge durability.

With the construction discussed above, the TBC 60 of the second surface 40 is at least one of coplanar with and/or recessed from the plane of the distal edge 555 of the rib 55. As such, the TBC 60 of the second surface 40 is isolated and separated from the TBC 60 of the first surface 20. Thus, the TBC 60 of the first surface 20 and the TBC 60 of the second surface 40 need not be made of the same materials, need not be formed simultaneously and need not be formed over the interface zone 45. The TBCs 60 therefore do not tend to deteriorate, crack or peel away at the interface zone 45 and expose the materials of the distal edge 555. The exposed materials of the distal edge 555 can be tested for various concerns, such as temperature profiles of the component 10. This testing may be conducted, for example, by way of infrared (IR) imaging of the distal edge 555.

Alternatively, as shown in FIG. 3, the depth, D, of the pocket 50 may be less than that of the TBC 60 such that the TBC 60 of the second surface 40 protrudes from the plane of the distal edge 555 of the rib 55. In this case, dimensions of the mate face gap, G, can be additionally controlled.

Also, as shown in FIG. 3, the rib 55 can be defined as a singular feature or as a plurality of ribs 551. Where the rib 55 is defined as a plurality of ribs 551, the plurality of ribs 551 may be arranged to restrict hot gas ingestion, to restrict undesired gas flow direction and/or to guide desired gas flow direction in the mate face gap, G.

Figure 6:
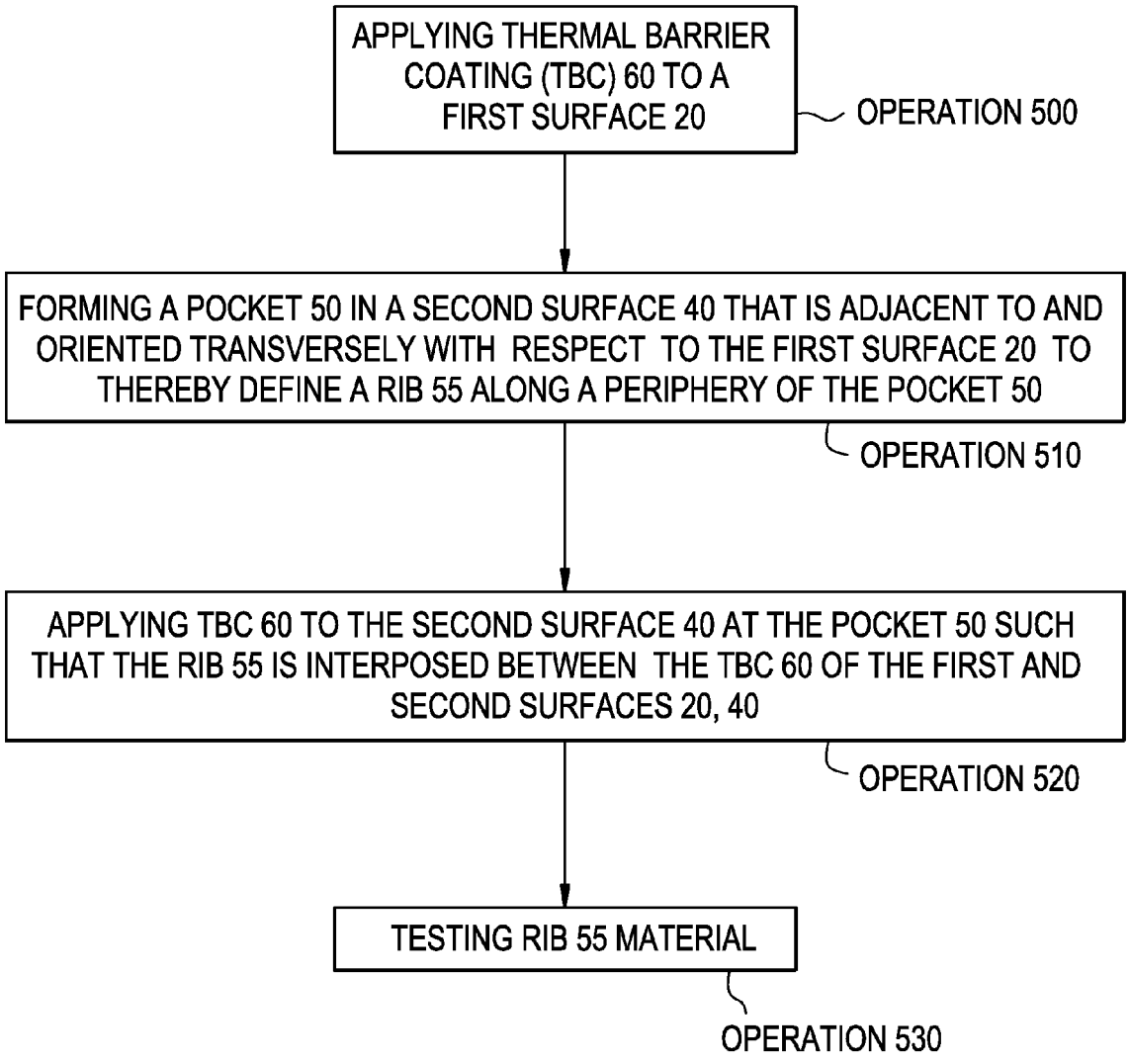
FIG. 6 is a flow diagram of a method.

With reference to FIG. 6, a method is provided and includes applying a thermal barrier coating (TBC) 60 to a first surface 20 (operation 500), forming a pocket 50 in a second surface 40 that is adjacent to and oriented transversely with respect to the first surface 20 to thereby define a rib 55 along a periphery of the pocket 50 (operation 510) and applying TBC 60 to the second surface 40 at the pocket 50 such that the rib 55 is interposed between the TBC 60 of the first and second surfaces 20, 40 (operation 520).

In accordance with embodiments, the forming of the pocket 50 of operation 510 may include at least one or more of electro-dynamic machining (EDM), milling, casting, grinding and/or another similar process. The forming of the pocket 50 of operation 510 may also include forming the pocket 50 with a substantially uniform depth, D, or forming the pocket 50 in accordance with a heat flux characteristic of the component 10. As mentioned above, in the latter case, the depth, D, of the pocket 50 may be non-uniform with, for example, a greatest depth, D, proximate to at least one of a leading and a trailing edge 200, 201 of the first surface 20.

In accordance with further embodiments, the applying of the TBC 60 to the second surface 40 of operation 520 may include stopping TBC 60 application before the pocket 50 is overfilled. In this way, the TBCs 60 of the first and second surfaces 20, 40 can be isolated and separated from one another and the distal edge 555 of the rib 55 can be exposed such that, for example, the material of the rib 55 can be tested (operation 530).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A component, comprising:

a first surface comprising a surface of a turbine bucket platform facing a gas path;

a second surface adjacent to and oriented transversely with respect to the first surface and having a pocket formed therein defining a rib along a periphery thereof; and a thermal barrier coating (TBC) respectively applied to the first surface and to the second surface at the pocket such that the rib is interposed between and exposed by the TBC of each of the first and second surfaces.

2. The component according to claim 1, wherein the first and second surfaces each comprise surfaces facing a gas path along which fluids having relatively high temperatures flow.

3. The component according to claim 2, wherein temperatures of the fluids exceed interior temperatures of the component.

4. The component according to claim 1, wherein the second surface comprises a surface of a slashface adjacent to the turbine bucket platform surface.

5. The component according to claim 4, wherein the second surface comprises a surface of the turbine bucket platform facing an aft trench cavity.

6. The component according to claim 4, wherein the TBC of the slashface is formed as a single continuous coating.

7. The component according to claim 4, wherein the TBC of the slashface is formed with non-continuous sections, each non-continuous section having similar or dissimilar thicknesses.

8. The component according to claim 4, wherein the second surface is formed to define an active cooling section proximate to the TBC of the slashface.

9. The component according to claim 4, wherein the second surface is formed to define a microchannel proximate to the TBC of the slashface.

10. The component according to claim 4, wherein the TBC of the slashface has a continuously variable thickness.

11. The component according to claim 1, wherein a depth of the pocket is one of substantially uniform or greatest proximate to at least one of a leading and a trailing edge of the first surface.

12. The component according to claim 1, wherein the TBC of the second surface is at least one of coplanar with and recessed from a plane of a distal edge of the rib forming a land edge.

13. The component according to claim 1, wherein the TBC of the second surface protrudes from a plane of a distal edge of the rib.

14. The component according to claim 1, wherein a separation of the TBC of the first and second surfaces provides heat flux directional control.

15. The component according to claim 1, wherein the rib comprises a sacrificial environment condition indicator.

16. The component according to claim 1, wherein the rib is defined as a plurality of ribs.

17. The component according to claim 1, wherein a film hole for cooling flow is defined through the second surface and the TBC of the second surface, the cooling flow being entrained, controlled and/or trapped by the pocket.

18. A turbine bucket platform, comprising:

a first surface of a turbine bucket platform facing a gas path;

a second surface of at least one of a slashface adjacent to the turbine bucket platform surface and a surface of the turbine bucket platform facing an aft trench cavity, the second surface having a pocket formed therein defining a rib along a periphery thereof; and a thermal barrier coating (TBC) respectively applied to the first surface and to the second surface at the pocket such that the rib is interposed between and exposed by the TBC of each of the first and second surfaces.

19. A method, comprising:

applying a thermal barrier coating (TBC) to a first surface of a turbine bucket platform facing gas path;

forming a pocket in a second surface adjacent to and oriented transversely with respect to the first surface to define a rib along a periphery of the pocket; and applying the TBC to the second surface at the pocket such that the rib is interposed between and exposed by the TBC of each of the first and second surfaces.

20. The method according to claim 19, wherein the forming the pocket comprises at least one of electro-dynamic machining (EDM), milling, casting and grinding.

* * * * *